US008397515B2

(12) United States Patent
Frederick

(10) Patent No.: US 8,397,515 B2
(45) Date of Patent: Mar. 19, 2013

(54) FUEL NOZZLE FLASHBACK DETECTION

(75) Inventor: Garth Curtis Frederick, Greenville, SC (US)

(73) Assignee: General Electric Company, Schenectady, NY (US)

( * ) Notice: Subject to any disclaimer, the term of this patent is extended or adjusted under 35 U.S.C. 154(b) by 909 days.

(21) Appl. No.: 12/432,855

(22) Filed: Apr. 30, 2009

(65) Prior Publication Data

US 2010/0275573 A1 Nov. 4, 2010

(51) Int. Cl.
*F02C 7/26* (2006.01)
*F02C 7/22* (2006.01)

(52) U.S. Cl. ..... 60/776; 60/39.281; 60/39.11; 431/19

(58) Field of Classification Search ..... 60/39.281, 60/772, 776, 781, 746, 747, 39.024, 39.091, 60/39.11, 779; 431/19, 346
See application file for complete search history.

(56) References Cited

U.S. PATENT DOCUMENTS 2,095,065 A * 10/1937 Hays ..... 431/7
2,858,671 A 11/1958 Fox
4,570,490 A 2/1986 Antonazzi
4,744,670 A 5/1988 Janssen
5,791,889 A 8/1998 Gemmen et al.
5,857,320 A 1/1999 Amos et al.
5,901,555 A * 5/1999 Mandai et al. ..... 60/747
5,961,314 A * 10/1999 Myhre et al. ..... 431/79
5,964,086 A * 10/1999 Kraemer ..... 60/776
6,003,296 A * 12/1999 Citeno et al. ..... 60/772
6,164,055 A 12/2000 Lovett et al.
6,357,216 B1 3/2002 Scott et al.
6,438,961 B2 8/2002 Tuthill et al.
6,708,568 B2 3/2004 Gleeson et al.
6,848,319 B2 2/2005 Gleeson et al.
6,857,320 B2 2/2005 Gleeson et al.
6,978,680 B2 12/2005 Gleeson et al.
7,017,415 B2 3/2006 Harrold et al.
7,036,302 B2 * 5/2006 Myers, Jr. et al. ..... 60/39.281
7,111,463 B2 9/2006 Sprouse et al.
7,185,494 B2 * 3/2007 Ziminsky et al. ..... 60/746
7,454,892 B2 * 11/2008 Lieuwen et al. ..... 60/39.091
7,721,553 B2 5/2010 Miller et al.
7,775,052 B2 8/2010 Cornwell et al.
7,788,895 B2 9/2010 Fujii
7,853,433 B2 * 12/2010 He et al. ..... 702/182
2006/0046218 A1 3/2006 Joklik et al.

(Continued)

OTHER PUBLICATIONS

Final Office Action for U.S. Appl. No. 12/356,799 mailed Apr. 6, 2012.

(Continued)

*Primary Examiner* — William H Rodriguez
*Assistant Examiner* — Karthik Subramanian
(74) *Attorney, Agent, or Firm* — Cantor Colburn LLP

(57) ABSTRACT

A combustor of a turbine engine having a combustion zone defined therein is provided and includes a fuel nozzle, including two or more burners, each of the burners having a passage defined therein through which combustible materials are permitted to travel toward the combustion zone, a plurality of sensors disposed in relative association with each of the burners to respectively sense static pressures within the passages of each of the burners and to respectively issue sensed static pressure signals accordingly, and a controller, coupled to the sensors and receptive of the signals, which is configured to determine from an analysis of the signals whether any of the burners are associated with a flashback risk and to mitigate the flashback risk in accordance with the determination.

22 Claims, 3 Drawing Sheets

U.S. PATENT DOCUMENTS

| | | | | |
|---|---|---|---|---|
| 2007/0006596 | A1 | 1/2007 | Fujii | |
| 2007/0119147 | A1* | 5/2007 | Cornwell et al. | 60/39.281 |
| 2008/0010966 | A1* | 1/2008 | Taware et al. | 60/39.27 |
| 2008/0053097 | A1* | 3/2008 | Han et al. | 60/737 |
| 2009/0013693 | A1* | 1/2009 | Ols et al. | 60/735 |
| 2010/0170217 | A1 | 7/2010 | Kraemer et al. | |
| 2010/0180564 | A1 | 7/2010 | Ziminsky et al. | |

OTHER PUBLICATIONS

Non Final Office Action for U.S. Appl. No. 12/356,799 mailed Dec. 2, 2011.

* cited by examiner

FUEL NOZZLE FLASHBACK DETECTION

BACKGROUND OF THE INVENTION

The subject matter disclosed herein relates to fuel nozzle flashback detection.

A combustor of a gas turbine engine has a combustion zone defined therein and includes one or more fuel nozzles that provide combustible materials to the combustion zone. The fuel nozzles include arrangements of one or more burners that each have passages defined therein through which the combustible materials, such as mixtures of fuel and air, travel toward the combustion zone. As the combustible materials reach the aft ends of the burners, they are ignited and combust. Generally, this combustion occurs within the primary and secondary recirculation zones of the combustion zone and, while, temperatures at the burners can reach relatively highly elevated levels, these temperatures are usually within established temperature parameters for burner operation without significant damage.

Occasionally, however, flashbacks occur. During flashbacks combustion of the combustible materials takes place abnormally close to or within the burners and temperatures at the burners exceed the established temperature parameters. Since the burner components are not typically designed to withstand such conditions, damage to the burners and the fuel nozzles can ensue. This damage may necessitate a costly shutdown of the gas turbine engine, repairs and/or replacement of the burners and the fuel nozzles.

Mitigating a likelihood of a flashback for any particular fuel nozzle or burner can involve designing the fuel nozzle with a 20% margin on burner tube velocity for given fuels. That is, each particular fuel nozzle is designed for use with selected fuels with the expectation that certain quantities of those fuels would be supplied to the fuel nozzles at certain velocities during gas turbine operations. Drawbacks associated with the 20% margin exist, however, in that alternate fuels cannot be substituted for the given fuels at a later date without, at least, significant testing and damage risks.

BRIEF DESCRIPTION OF THE INVENTION

According to one aspect of the invention, a combustor of a turbine engine having a combustion zone defined therein is provided and includes a fuel nozzle, including two or more burners, each of the burners having a passage defined therein through which combustible materials are permitted to travel toward the combustion zone, a plurality of sensors disposed in relative association with each of the burners to respectively sense static pressures within the passages of each of the burners and to respectively issue sensed static pressure signals accordingly, and a controller, coupled to the sensors and receptive of the signals, which is configured to determine from an analysis of the signals whether any of the burners are associated with a flashback risk and to mitigate the flashback risk in accordance with the determination.

According to another aspect of the invention, a burner of a fuel nozzle of a turbine engine combustor having a combustion zone defined therein is provided and includes an annular shroud terminating at a forward end of the combustor, a center body disposed within the annular shroud to define an annular passage extending between the annular shroud and the center body through which combustible materials travel toward the combustion zone, and a plurality of sensors, which are disposed in relative association with the shroud, to respectively sense static pressures within the passage and to respectively issue sensed static pressure signals accordingly for use in determining a flashback risk and for use in mitigating the flashback risk.

According to yet another aspect of the invention, a method of controlling a fuel nozzle of a turbine engine combustor, including two or more burners, is provided and includes sensing static pressures within a passage defined in each of the burners, analyzing the static pressures to calculate an average static pressure within the passage in each of the burners, comparing the average static pressures with one another, determining from a result of the comparison whether one or more of the burners is associated with a flashback risk, and mitigating the flashback risk associated with the one or more of the burners in accordance with the determination.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
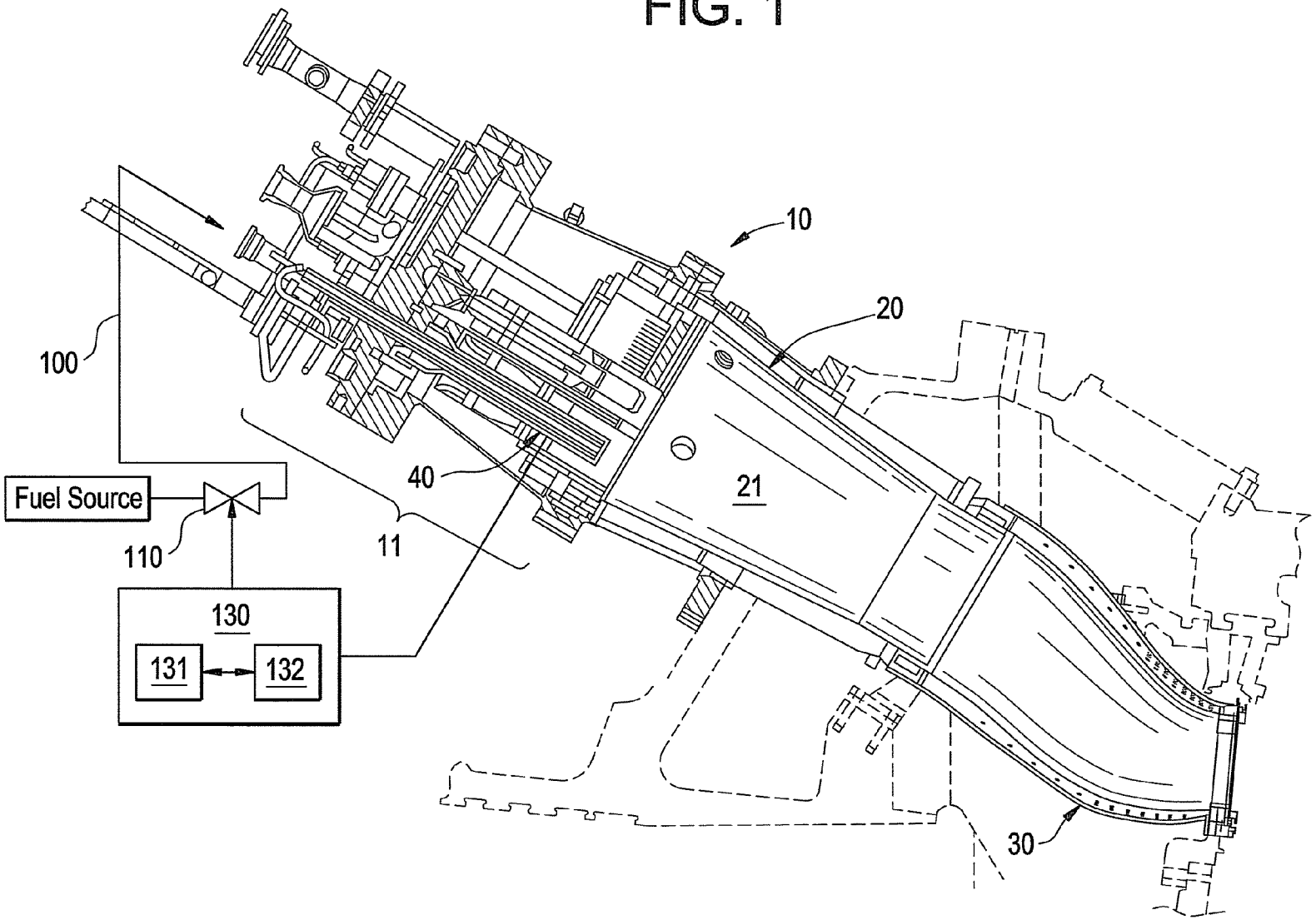
FIG. 1 is a side sectional view of a combustor of a turbine engine.

With reference to FIG. 1, a combustor 20 of a turbine engine 10 is provided. The combustor 20 has a combustion zone 21 defined therein, in which combustible materials are combusted for purposes of power generation. The combustor 20 is coupled to a transition piece 30 by which products of the combustion are provided to a turbine where the combustion products cause turbine blades to rotate about a rotor.

Figure 2:
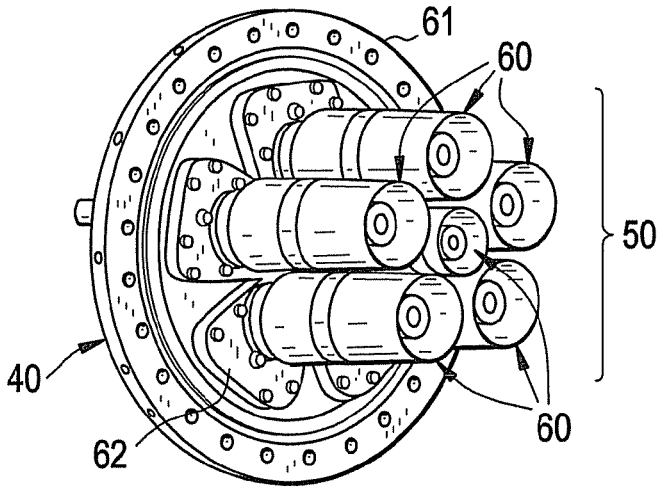
FIG. 2 is a perspective view of a fuel nozzle of the combustor of FIG. 1.

With reference to FIGS. 1 and 2, the combustor 20 includes a head end 11 that itself includes at least one fuel nozzle 40. The fuel nozzle 40 may be provided in various configurations, including, but not limited to, the DLN 2.0, DLN 2+, DLN 2.5+, DLN 2.6 and DLN 2.6+ configurations. As an example, the fuel nozzle 40 of FIG. 2 represents the DLN 2.6+ configuration and includes a nozzle arrangement 50 in which a burner 60 is surrounded by five additional burners 60 with each burner 60 oriented in parallel with the others. The burners 60 are supported in this arrangement by a planar base 61, which is structurally supported by the head end 11, and base members 62 that couple the burners 60 to the base 61.

Figure 3:
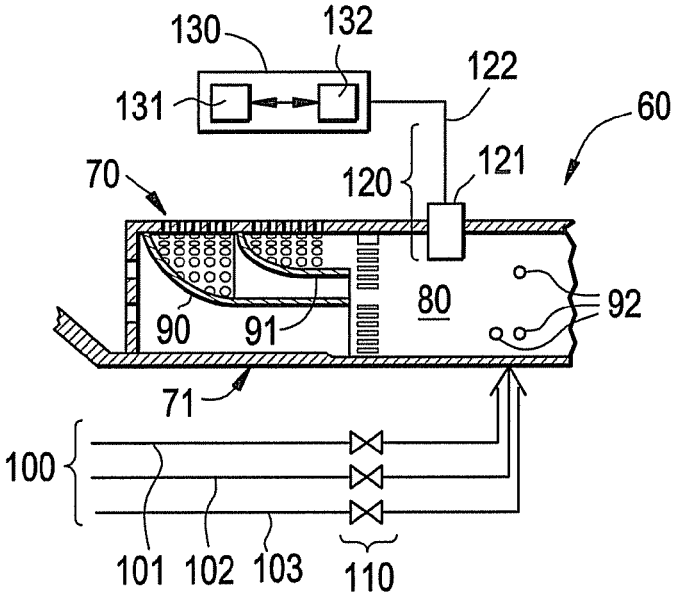
FIG. 3 is an enlarged side sectional view of a burner and a static pressure sensor.

With reference to FIG. 3, each of the burners 60 includes an annular shroud 70 that terminates proximate to the combustion zone 21 of the combustor 20 and a center body 71, which is disposed within the annular shroud 70. In this way, an annular passage 80 is defined within each burner 60 in the annular space between the annular shroud 70 and the center body 71. The combustible materials are permitted to travel through the annular passage 80 toward the combustion zone.

The combustible materials include mixtures of air and fuel in varying quantities based on turbine engine load requirements, emissions requirements and additional considerations. The air may be provided as compressed air produced by a compressor that enters the passage 80 by way of inlets 90 and 91. The fuel may be provided as varied types of premixed fuel, diffusion fuel and/or liquid fuel and is delivered in at least one or more of these forms to the annular passage 80 via fuel injectors 92 by way of a fuel delivery system 100, coupled to a fuel source, which includes lines 101, 102 and 103. Valves 110 are provided along each line 101, 102 and 103 that allow for quantities of fuel deliverable to the passage 80 to be controlled.

Figure 4:
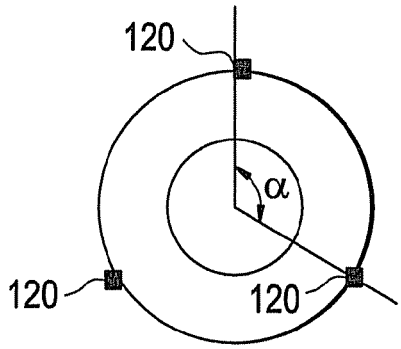
FIG. 4 is a schematic view of a burner including static pressure sensors.

With reference to FIGS. 3 and 4, three or more pressure sensors 120 are disposed in relative association with each of the burners 60 to respectively sense static pressures within the passages 80 of each of the burners 60. The pressure sensors 120 are further configured to respectively issue sensed static pressure signals in accordance with the sensed static pressures. The pressure sensors 120 may include pressure taps 121 that penetrate the annular shrouds 70 of each of the burners 60 at, for example, an axial position of the burners 60 between those of swirlers aft of the inlets 90 and 91 and those of the fuel injectors 92. The pressure sensors 120 may further include tubing 122, which is installed onto an exterior of the shrouds 70 or, as an alternative, which is defined within and as part of the shrouds 70 themselves.

With reference to FIG. 4, the pressure sensors 120 of each of the burners 60 are perimetrically disposed about the corresponding burner 60 and may be separated from one another at regular intervals. Therefore, as shown in FIG. 4, where three pressure sensors 120 are disposed in the relative association with each burner 60, the pressure sensors 120 of each burner 60 are separated from one another by 120°. Of course, is it to be understood that more than three pressure sensors 120 could be disposed in the relative association with each burner 60 and, in such cases, the separation between the pressure sensors 120 is correspondingly decreased.

While the pressure sensor 120 configurations described above relate to configurations of three or more pressure sensors 120 for each burner 60, these configurations are merely exemplary and it is understood that configurations of one or two pressure sensors 120 are possible.

The combustor 20 further includes a controller 130, which is coupled to each of the pressure sensors 120. The controller 130 is receptive of the sensed static pressure signals and includes a processing unit 131 and a memory unit 132, which is coupled to the processing unit 131. The memory unit 132 may be embodied as a computer readable medium having executable instructions stored thereon, which, when executed, cause the processing unit 131 to determine from an analysis of the signals whether any of the burners 60 are associated with a flashback risk.

The processing unit 131 analyses the signals by first calculating an average static pressure within the passages 80 of each of the burners 60. The processing unit 131, acting as a comparator, then compares the average static pressures of each of the burners 60 to one another. Here, the processing unit 131 judges that one or more of the burners 60 is associated with the flashback risk if the average static pressures within their respective passages 80 are less than the averages of the other ones of the burners by a threshold level. The threshold level may be established by testing done at the point of burner 60 manufacture. The threshold level may also be updated throughout the lifecycle of the turbine engine in accordance with ongoing performance analyses.

With the processing unit 131 of the controller 130 judging that a burner 60 is associated with a flashback risk, the controller 130 is further configured to mitigate the flashback risk. To this end, the controller 130 may be controllably coupled to at least the valves 110 of the fuel delivery system 100. In this way, the controller 130 may open or close the valves 110 in order to increase or decrease an amount of fuel deliverable to the burner 60 at risk. Thus, an at-risk burner 60 can be starved of fuel by way of the closing of its associated valve 110 and a flashback incident with respect to that burner 60 can be avoided. Additionally or alternatively, the controller 130 may be configured to decrease a turbine engine load. In this way, an overall fuel demand of the turbine engine is lowered along with temperatures within at least the combustion zone 21. Here, the possibility of flashback occurring in any particular burner 60 is correspondingly decreased.

Figure 5:
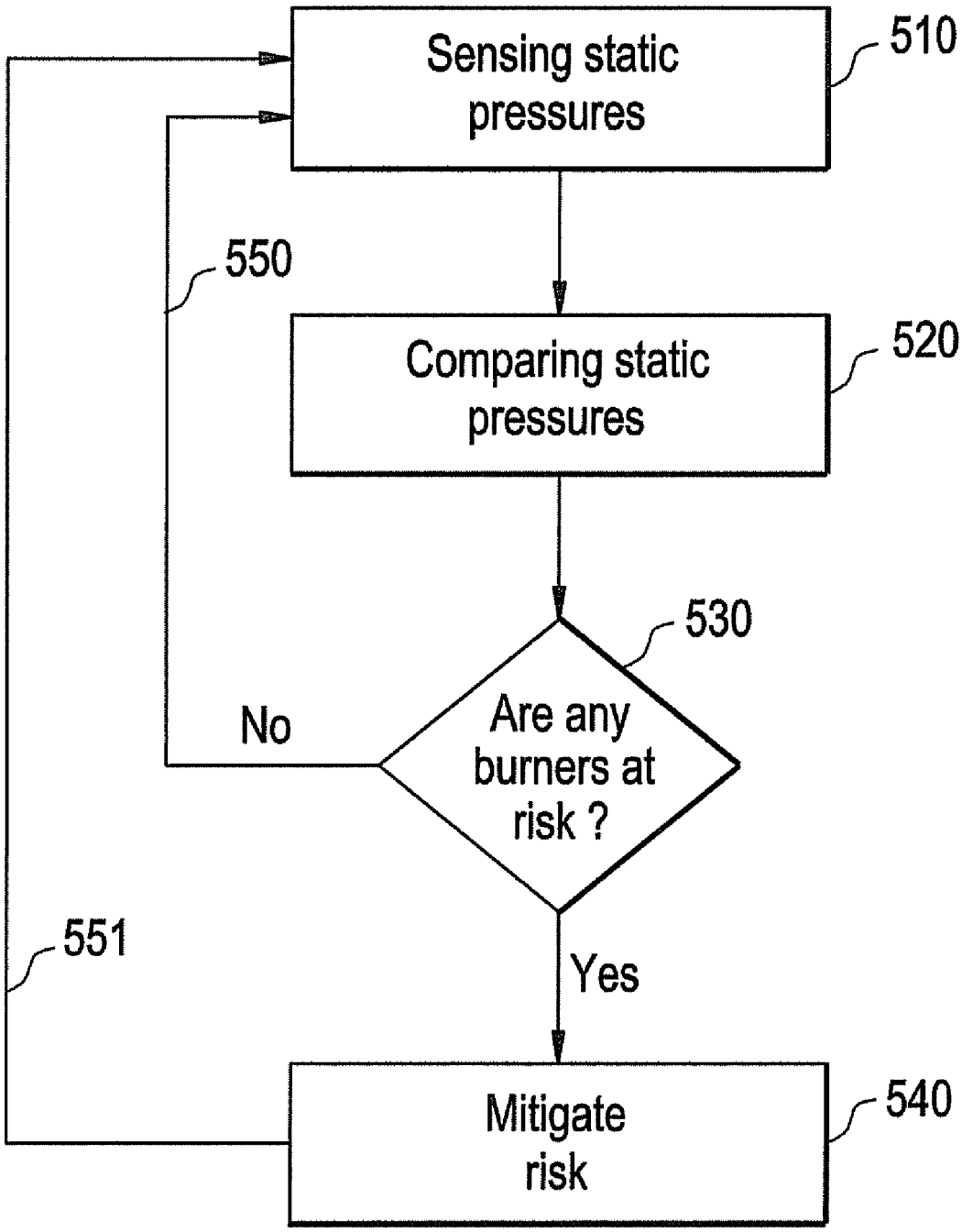
FIG. 5 is a flow diagram illustrating a method of operating a fuel nozzle.

With reference to FIG. 5 and, in accordance with another aspect of the invention, a method of controlling a fuel nozzle 40 of a turbine engine combustor, including two or more burners 60, is provided. The method includes sensing static pressures within a passage 80 defined in each of the burners 500, analyzing the static pressures to calculate an average static pressure within the passage 80 in each of the burners 510 and comparing the average static pressures with one another 520. From a result of the comparison, it is then determined whether one or more of the burners 60 is associated with a flashback risk 530. If no burner 60 is found to be at risk, control returns to the static pressure sensing 510 along loop 550. Conversely, if any burner 60 is found to be at risk, the flashback risk associated with the one ore more of the burners 60 is mitigated 540. Subsequently, control returns to the static pressure sensing 510 along loop 551.

As described above, the determining includes judging that the one or more of the burners 60 is associated with the flashback risk if corresponding ones of the average static pressures are less than the average static pressures of other ones of the burners 60 by a threshold level. Similarly, the mitigating includes decreasing an amount of fuel deliverable to the one or more of the at-risk burners 60 and/or decreasing a turbine engine load.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor of a turbine engine having a combustion zone defined therein, comprising:

a fuel nozzle, including two or more burners, each of the burners having a passage defined therein through which combustible materials are permitted to travel toward the combustion zone;

a plurality of sensors disposed in relative association with each of the burners to respectively sense static pressures within the passages of each of the burners and to respectively issue sensed static pressure signals accordingly; and a controller, coupled to the sensors and receptive of the signals, which is configured to determine from an analysis of the signals whether any of the burners are associated with a flashback risk and to mitigate the flashback risk in accordance with the determination.

2. The combustor according to claim 1, wherein each of the sensors comprises a pressure tap penetrating the corresponding burner.

3. The combustor according to claim 1, wherein the sensors each comprise tubing installed onto the corresponding burner.

4. The combustor according to claim 1, wherein the sensors each comprise tubing built into the corresponding burner.

5. The combustor according to claim 1, wherein the sensors of each of the burners are perimetrically disposed about the corresponding burner.

6. The combustor according to claim 1, wherein the sensors of each of the burners are separated from one another at regular intervals.

7. The combustor according to claim 1, wherein the controller analyzes the signals by calculating an average static pressure of each of the burners and comparing the average with averages of other ones of the burners.

8. The combustor according to claim 7, wherein the one or more of the burners is associated with the flashback risk if a corresponding one or more of the averages is less than the averages of the other ones of the burners by a threshold level.

9. The combustor according to claim 8, wherein the threshold level is established by testing.

10. The combustor according to claim 8, wherein the threshold level is established by testing and updated during a lifecycle of the turbine engine.

11. The combustor according to claim 1, wherein the controller is controllably coupled to a fuel system, by which a quantity of fuel is deliverable to each of the burners, to modify the quantity of fuel.

12. The combustor according to claim 1, wherein the controller is configured to decrease an amount of fuel deliverable to the burners associated with the flashback risk.

13. A burner of a fuel nozzle of a turbine engine combustor having a combustion zone defined therein, comprising:

an annular shroud terminating at a forward end of the combustor;

a center body disposed within the annular shroud to define an annular passage extending between the annular shroud and the center body through which combustible materials travel toward the combustion zone; and a plurality of sensors, which are disposed in relative association with the shroud, to respectively sense static pressures within the passage and to respectively issue sensed static pressure signals accordingly for use in determining a flashback risk and for use in mitigating the flashback risk.

14. The burner according to claim 13, wherein the sensors each comprise a pressure tap penetrating the shroud.

15. The burner according to claim 13, wherein each of the sensors comprises tubing installed onto the shroud.

16. The burner according to claim 13, wherein each of the sensors comprises tubing built into the shroud.

17. The burner according to claim 13, wherein the sensors are parametrically disposed about the shroud.

18. The burner according to claim 13, wherein the sensors are separated from one another at regular intervals.

19. A method of controlling a fuel nozzle of a turbine engine combustor, including two or more burners, the method comprising:

sensing static pressures within a passage defined in each of the burners;

analyzing the static pressures to calculate an average static pressure within the passage in each of the burners;

comparing the average static pressures for each burner with one another;

determining from a result of the comparison whether one or more of the burners is associated with a flashback risk; and mitigating the flashback risk associated with the one or more of the burners in accordance with the determination.

20. The method according to claim 19, wherein the determining comprises judging that the one or more of the burners is associated with the flashback risk if corresponding ones of the averages are less than the averages of other ones of the burners by a threshold level.

21. The method according to claim 19, wherein the mitigating comprises decreasing an amount of fuel deliverable to the one or more of the burners associated with the flashback risk.

22. The method according to claim 19, wherein the mitigating comprises decreasing a turbine engine load.

* * * * *